US010435761B2

(12) United States Patent
Tabata et al.

(10) Patent No.: US 10,435,761 B2
(45) Date of Patent: Oct. 8, 2019

(54) HEAT-TREATED STEEL MATERIAL AND METHOD OF MANUFACTURING THE SAME

(71) Applicant: NIPPON STEEL & SUMITOMO METAL CORPORATION, Tokyo (JP)

(72) Inventors: Shinichiro Tabata, Tokyo (JP); Kazuo Hikida, Tokyo (JP); Nobusato Kojima, Tokyo (JP); Naomitsu Mizui, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 873 days.

(21) Appl. No.: 14/893,355

(22) PCT Filed: Jun. 6, 2014

(86) PCT No.: PCT/JP2014/065151
§ 371 (c)(1),
(2) Date: Nov. 23, 2015

(87) PCT Pub. No.: WO2014/196645
PCT Pub. Date: Dec. 11, 2014

(65) Prior Publication Data

US 2016/0102380 A1 Apr. 14, 2016

(30) Foreign Application Priority Data

Jun. 7, 2013 (JP) ..... 2013-120973

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/24*** | (2006.01) |
| ***C22C 38/28*** | (2006.01) |
| ***C22C 38/32*** | (2006.01) |
| ***C22C 38/48*** | (2006.01) |
| ***C22C 38/54*** | (2006.01) |
| ***C21D 8/02*** | (2006.01) |
| ***C21D 1/84*** | (2006.01) |
| ***C21D 6/00*** | (2006.01) |
| ***C22C 38/22*** | (2006.01) |
| ***C22C 38/26*** | (2006.01) |
| ***C22C 38/38*** | (2006.01) |
| ***C22C 38/50*** | (2006.01) |
| *C21D 8/04* | (2006.01) |

(52) U.S. Cl.

CPC ..... *C21D 9/46* (2013.01); *C21D 1/84* (2013.01); *C21D 6/004* (2013.01); *C21D 6/005* (2013.01); *C21D 6/008* (2013.01); *C21D 8/0273* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/48* (2013.01); *C22C 38/50* (2013.01); *C22C 38/54* (2013.01); *C21D 8/0473* (2013.01); *C21D 2211/008* (2013.01)

(58) Field of Classification Search

CPC ..... C21D 9/46

See application file for complete search history.

(56) References Cited

U.S. PATENT DOCUMENTS

| | | | |
|---|---|---|---|
| 2006/0137780 | A1 | 6/2006 | Beguinot et al. |
| 2006/0144483 | A1 | 7/2006 | Beguinot et al. |
| 2006/0185774 | A1 | 8/2006 | Nishibata et al. |
| 2007/0017272 | A1 | 1/2007 | Kurisu et al. |
| 2008/0110535 | A1 | 5/2008 | Oi et al. |
| 2011/0048589 | A1 | 3/2011 | Matsuda et al. |
| 2011/0219843 | A1 | 9/2011 | Kurisu et al. |
| 2011/0219848 | A1 | 9/2011 | Kurisu et al. |
| 2011/0219849 | A1 | 9/2011 | Kuriso et al. |
| 2013/0340899 | A1 | 12/2013 | Kusumi et al. |
| 2014/0124102 | A1 | 5/2014 | Zhang et al. |

FOREIGN PATENT DOCUMENTS

| | | | |
|---|---|---|---|
| CN | 102031455 | A | 4/2011 |
| CN | 102031456 | A | 4/2011 |
| EP | 1956108 | A1 | 8/2008 |
| EP | 1 642 991 | B1 | 2/2009 |
| EP | 2546379 | A1 | 1/2013 |

(Continued)

OTHER PUBLICATIONS

Russian Office Action and Search Report, dated Apr. 18, 2017, for corresponding Russian Application No. 2015150123, with an English translation.

Japanese Office Action for Japanese Application No. 2015-521511, dated Feb. 7, 2017, with a partial English translation.

Tabata et al., "Effects of Microstructures on Yield Strength of Hot-Pressed Steel Sheets," CAMP-ISIJ, vol. 25, 2012, p. 253.

Extended European Search Report for corresponding European Application No. 14808254.8, dated Feb. 3, 2017.

(Continued)

*Primary Examiner* — Jessee R Roe
*Assistant Examiner* — Jophy S. Koshy
(74) *Attorney, Agent, or Firm* — Birch, Stewart, Kolasch & Birch, LLP

(57) ABSTRACT

A heat-treated steel material includes: a chemical composition expressed by, in mass %: C: 0.16% to 0.38%; Mn: 0.6% to 1.5%; Cr: 0.4% to 2.0%; Ti: 0.01% to 0.10%; B: 0.001% to 0.010%; Si: 0.20% or less; P: 0.05% or less; S: 0.05% or less; N: 0.01% or less; Ni: 0% to 2.0%; Cu: 0% to 1.0%; Mo: 0% to 1.0%; V: 0% to 1.0%; Al: 0% to 1.0%; Nb: 0% to 1.0%; REM: 0% to 0.1%; and the balance: Fe and impurities; and a structure expressed by: retained austenite: 1.5 volume % or less; and the balance: martensite.

8 Claims, No Drawings

(56) References Cited

FOREIGN PATENT DOCUMENTS

| | | | |
|---|---|---|---|
| JP | 2002-102980 | A | 4/2002 |
| JP | 2002-180186 | A | 6/2002 |
| JP | 2004-353026 | A | 12/2004 |
| JP | 2005-169394 | A | 6/2005 |
| JP | 2007-211276 | A | 8/2007 |
| JP | 2007-291464 | A | 11/2007 |
| JP | 2009-203549 | A | 9/2009 |
| JP | 2010-242164 | A | 10/2010 |
| JP | 2011-52320 | A | 3/2011 |
| JP | 2011-52321 | A | 3/2011 |
| JP | 2012-77336 | A | 4/2012 |
| JP | 2014-2275815 | A | 12/2014 |
| KR | 10-2006-0018860 | A | 3/2006 |
| KR | 10-0716342 | B1 | 5/2007 |
| RU | 2326180 | C2 | 6/2008 |
| RU | 2327802 | C2 | 6/2008 |
| WO | WO 2011/118459 | A1 | 9/2011 |
| WO | WO 2012/120692 | A1 | 9/2012 |
| WO | WO 2013/075473 | A1 | 5/2013 |

OTHER PUBLICATIONS

Han et al., "Application of Hot Stamping Process by Integrating Quenching & Partitioning Heat Treatment to Improve Mechanical Properties," Procedia Engineering, vol. 81, No. 10, 2014 (11th ICTP, Nagoya, Japan, Oct. 19-24, 2014), pp. 1737-1743.

Canadian Office Action and Search Report dated Sep. 8, 2017, for corresponding Canadian Application No. 2,913,487.

International Search Report, issued in PCT/JP2014/065151, dated Aug. 19, 2014.

Nishibata et al., "Effect of Quenching Rate on Hardness and Microstructure of Hot-Stamped Steel", Tetsu-to-Hagane, 2010, vol. 96, No. 6, pp. 378-385.

Written Opinion of the International Searching Authority, issued in PCT/JP2014/065151, dated Aug. 19, 2014.

International Preliminary Report on Patentability and English translation of the Written Opinion of the International Searching Authority (forms PCT/IB/373, PCT/ISA/237 and PCT/IB/338), dated Dec. 17, 2015, for International Application No. PCT/JP2014/065151.

Korean Office Action, dated Oct. 19, 2016, for Korean Application No. 10-2015-7034351, with English summary.

Indian Office Action for Indian Application No. 10910/DELNP/2015, dated Aug. 6, 2019, with English translation.

HEAT-TREATED STEEL MATERIAL AND METHOD OF MANUFACTURING THE SAME

TECHNICAL FIELD

The present invention relates to a heat-treated steel material used for automobiles and so on and a method of manufacturing the same.

BACKGROUND ART

Steel sheets for automobiles are required to realize improvement of fuel efficiency and collision resistance. Accordingly, attempts are being made to increase strength of the steel sheets for automobiles. However, the improvement of strength is generally accompanied by a decrease of ductility such as press formability and accordingly makes it difficult to manufacture a component having a complicated shape. For example, in accordance with the decrease of ductility, a highly-worked portion fractures, or springback and wall warping are become significant to deteriorate dimensional accuracy. Therefore, it is not easy to manufacture a component by press-forming a high-strength steel sheet, especially, a steel sheet having 780 MPa tensile strength or more. Roll forming instead of the press forming can easily work a high-strength steel sheet, but its application is only limited to a component having a uniform cross section in a longitudinal direction.

Patent Literature 1 discloses a method called hot pressing having an object to obtain high formability in a high-strength steel sheet. By the hot pressing, it is possible to form a high-strength steel sheet highly accurately to obtain a hot-pressed steel sheet material having high strength.

Patent Literature 2 discloses a hot forming method having an object to obtain stable strength and toughness, and Patent Literature 3 discloses a steel sheet aiming at improved formability and hardenability. Patent Literature 4 discloses a steel sheet aiming at realizing both strength and formability, Patent Literature 5 discloses an art having an object to manufacture steel sheets having a plurality of strength levels from the same steel type, and Patent Literature 6 discloses a method of manufacturing a steel pipe having an object to improve formability and torsional fatigue resistance. Patent Literature 7 discloses an art to improve a cooling rate in hot forming. Non-patent Literature 1 discloses a relation between a cooling rate in quenching, and hardness and a structure of a hot-pressed steel material.

Incidentally, collision resistance of an automobile depends on not only tensile strength but also yield strength and toughness suitable for the tensile strength. For example, for a bumper reinforce, a center pillar, and the like, it is required that plastic deformation is suppressed as much as possible so as not to fracture soon even if they deform.

However, it is difficult to obtain excellent collision resistance by the aforesaid conventional arts.

CITATION LIST

Patent Literature

Patent Literature 1: Japanese Laid-open Patent Publication No. 2002-102980

Patent Literature 2: Japanese Laid-open Patent Publication No. 2004-353026

Patent Literature 3: Japanese Laid-open Patent Publication No. 2002-180186

Patent Literature 4: Japanese Laid-open Patent Publication No. 2009-203549

Patent Literature 5: Japanese Laid-open Patent Publication No. 2007-291464

Patent Literature 6: Japanese Laid-open Patent Publication No. 2010-242164

Patent Literature 7: Japanese Laid-open Patent Publication No. 2005-169394

Non-Patent Literature

Non-Patent Literature 1: Tetsu-to-Hagane, Vol. 96 (2010) No. 6 378

SUMMARY OF INVENTION

Technical Problem

It is an object of the present invention to provide a heat-treated steel material possible to obtain excellent collision resistance, and a method of manufacturing the same.

Solution to Problem

The present inventors have conducted studious studies in order to investigate a cause that makes it difficult to obtain sufficient tensile strength, and yield strength and toughness suitable for the tensile strength in a conventional heat-treated steel material manufactured through heat treatment such as hot stamping. As a result, it has been found out that the heat-treated steel material, even if appropriately heat-treated, unavoidably contains retained austenite in its structure, that yield strength decreases as a volume fraction of the retained austenite is higher, and that the decrease of the yield strength is mainly caused by the retained austenite.

The present inventors have also found out that, in order to reduce retained austenite, a cooling rate in quenching, especially, a cooling rate in a temperature range of a martensitic transformation point (Ms point) or lower is important.

The present inventors have also found out that, even if a steel sheet for heat treatment used for manufacturing a heat-treated steel material contains Cr and B, which greatly contribute to an improvement of hardenability, toughness of the heat-treated steel material manufactured from this steel sheet does not deteriorate. A conventional heat-treated steel material contains Mn for the purpose of improving hardenability, but Mn causes deterioration of toughness. If a steel sheet for heat treatment contains Cr and B, it is possible to ensure hardenability even if the Mn content is suppressed to low, so that toughness of the heat-treated steel material can be improved.

Then, the inventors of the present application have reached the following various forms of the invention based on these findings.

(1)

A heat-treated steel material including:

a chemical composition expressed by, in mass %:

C: 0.16% to 0.38%;

Mn: 0.6% to 1.5%;

Cr: 0.4% to 2.0%;

Ti: 0.01% to 0.10%;

B: 0.001% to 0.010%;

Si: 0.20% or less;

P: 0.05% or less;

S: 0.05% or less;

N: 0.01% or less;

Ni: 0% to 2.0%;
Cu: 0% to 1.0%;
Mo: 0% to 1.0%;
V: 0% to 1.0%;
Al: 0% to 1.0%;
Nb: 0% to 1.0%;
REM: 0% to 0.1%; and
the balance: Fe and impurities; and
a structure expressed by:
retained austenite: 1.5 volume % or less; and
the balance: martensite.

(2)

The heat-treated steel material according to (1), wherein C: 0.16 to 0.25% in the chemical composition.

(3)

The heat-treated steel material according to (1) or (2), including a mechanical property expressed by
a yield ratio: 0.70 or more.

(4)

The heat-treated steel material according to any one of (1) to (3), wherein the chemical composition satisfies:
Ni: 0.1% to 2.0%;
Cu: 0.1% to 1.0%;
Mo: 0.1% to 1.0%;
V: 0.1% to 1.0%;
Al: 0.01% to 1.0%;
Nb: 0.01% to 1.0%; or
REM: 0.001% to 0.1%; or
any combination thereof.

(5)

A method of manufacturing a heat-treated steel material, including:
heating a steel sheet to a temperature of an $Ac_3$ point or higher;
next cooling the steel sheet to a Ms point at a cooling rate equal to a critical cooling rate or more; and
next cooling the steel sheet from the Ms point to 100° C. at a 35° C./second average cooling rate or more, wherein
the steel sheet includes a chemical composition expressed by, in mass %:
C: 0.16% to 0.38%;
Mn: 0.6% to 1.5%;
Cr: 0.4% to 2.0%;
Ti: 0.01% to 0.10%;
B: 0.001% to 0.010%;
Si: 0.20% or less;
P: 0.05% or less;
S: 0.05% or less;
N: 0.01% or less;
Ni: 0% to 2.0%;
Cu: 0% to 1.0%;
Mo: 0% to 1.0%;
V: 0% to 1.0%;
Al: 0% to 1.0%;
Nb: 0% to 1.0%;
REM: 0% to 0.1%; and
the balance: Fe and impurities.

(6)

The method of manufacturing the heat-treated steel material according to (5), wherein C: 0.16 to 0.25% in the chemical composition.

(7)

The method of manufacturing the heat-treated steel material according to (5) or (6), wherein the chemical composition satisfies:
Ni: 0.1% to 2.0%;
Cu: 0.1% to 1.0%;
Mo: 0.1% to 1.0%;
V: 0.1% to 1.0%;
Al: 0.01% to 1.0%;
Nb: 0.01% to 1.0%; or
REM: 0.001% to 0.1%; or
any combination thereof.

(8)

The method of manufacturing the heat-treated steel material according to any one of (5) to (7), including forming the steel sheet after the heating the steel sheet to the temperature of the $Ac_3$ point or higher before a temperature of the steel sheet reaches the Ms point.

Advantageous Effects of Invention

According to the present invention, it is possible to obtain excellent collision resistance.

DESCRIPTION OF EMBODIMENTS

Hereinafter, an embodiment of the present invention will be described. A heat-treated steel material according to the embodiment of the present invention, which will be described in detail later, is manufactured by quenching a predetermined steel sheet for heat treatment. Therefore, hardenability and a quenching condition of the steel sheet for heat treatment influence the heat-treated steel material.

First, a chemical composition of the heat-treated steel material according to the embodiment of the present invention and the steel sheet for heat treatment used for manufacturing the same will be described. In the following description, "%" being a unit of the content of each element contained in the heat-treated steel material and the steel sheet used for manufacturing the same means "mass %" unless otherwise mentioned. The heat-treated steel material according to the embodiment and the steel sheet used for manufacturing the same include a chemical composition expressed by C: 0.16% to 0.38%, Mn: 0.6% to 1.5%, Cr: 0.4% to 2.0%, Ti: 0.01% to 0.10%, B: 0.001% to 0.010%, Si: 0.20% or less, P: 0.05% or less, S: 0.05% or less, N: 0.01% or less, Ni: 0% to 2.0%, Cu: 0% to 1.0%, Mo: 0% to 1.0%, V: 0% or 1.0%, Al: 0% to 1.0%, Nb: 0% to 1.0%, REM (rare earth metal): 0% to 0.1%, and the balance: Fe and impurities. Examples of the impurities are those contained in a raw material such as an ore and scrap iron, and those contained during manufacturing steps.

(C: 0.16% to 0.38%)

C is a very important element that enhances hardenability of the steel sheet for heat treatment and mainly affects strength of the heat-treated steel material. When the C content is less than 0.16%, strength of the heat-treated steel material is not sufficient. Therefore, the C content is 0.16% or more. When the C content is over 0.38%, the strength of the heat-treated steel material is too high, leading to a great deterioration of toughness. Therefore, the C content is 0.38% or less. The C content is preferably 0.36% or less.

The C content is preferably 0.16% to 0.25% to obtain tensile strength of not less than 1400 MPa nor more than 1700 MPa, and the C content is preferably over 0.25% and 0.38% or less to obtain tensile strength of over 1700 MPa and 2200 MPa or less.

(Mn: 0.6% to 1.5%)

Mn has a function to improve hardenability of the steel sheet for heat treatment, and enable to stably ensure strength of the heat-treated steel material. When the Mn content is less than 0.6%, it is not sometimes possible to sufficiently obtain the effect by the above function. Therefore, the Mn content is 0.6% or more. When the Mn content is over 1.5%, segregation is significant, resulting in deterioration of uniformity of a mechanical property to deteriorate toughness. Therefore, the Mn content is 1.5% or less. The Mn content is preferably 1.3% or less.

(Cr: 0.4% to 2.0%)

Cr has a function to improve hardenability of the steel sheet for heat treatment, and enable to stably ensure strength of the heat-treated steel material. When the Cr content is less than 0.4%, it is not sometimes possible to sufficiently obtain the effect by the above function. Therefore, the Cr content is 0.4% or more. When the Cr content is over 2.0%, Cr concentrates in carbide in the steel sheet for heat treatment, so that hardenability lowers. This is because, as Cr concentrates, solid dissolving of the carbide becomes slow during heating for quenching. Therefore, the Cr content is 2.0% or less. The Cr content is preferably 1.0% or less.

(Ti: 0.01% to 0.10%)

Ti has a function to greatly improve toughness of the heat-treated steel material. That is Ti suppresses recrystallization and forms further fine carbide so as to suppress grain growth of austenite in heat treatment at a temperature equal to an $Ac_3$ point or higher for quenching. Owing to the suppression of the grain growth, fine austenite grains are obtained, leading to a great improvement of toughness. Ti also has a function to preferentially bond with N in the steel sheet for heat treatment, thereby suppressing B from being consumed by the precipitation of BN. As will be described later, B also has a function to improve hardenability, and therefore, by suppressing the consumption of B, it is possible to surely obtain the effect of improving hardenability by B. When the Ti content is less than 0.01%, it is not sometimes possible to sufficiently obtain the effect by the above function. Therefore, the Ti content is 0.01% or more. When the Ti content is over 0.10%, a precipitation amount of TiC increases, so that C is consumed, and therefore, it is not sometimes possible to obtain sufficient strength. Therefore, the Ti content is 0.10% or less. The Ti content is preferably 0.08% or less.

(B: 0.001% to 0.010%)

B is a very important element having a function to greatly enhance hardenability of the steel sheet for heat treatment. B also has a function to strengthen a grain boundary to increase toughness by segregating at the grain boundary. B also has a function to suppress the grain growth of the austenite to improve toughness, similarly to Ti. When the B content is less than 0.001%, it is not sometimes possible to sufficiently obtain the effect by the above function. Therefore, the B content is 0.001% or more. When the B content is over 0.010%, a large amount of a coarse boride precipitates to deteriorate toughness. Therefore, the B content is 0.010% or less. The B content is preferably 0.006% or less.

(Si: 0.20% or less)

Si is not an essential element but is contained as impurities in steel, for instance. Si causes deterioration of yield strength accompanying an increase of retained austenite. Further, the higher the Si content is, the higher a temperature at which austenite transformation occurs. As this temperature is higher, a cost required for heating for quenching increases, or quenching is likely to be insufficient due to insufficient heating. Further, as the Si content is higher, wettability and alloying treatability of the steel sheet for heat treatment become lower, which lowers stability of hot dipping and alloying treatment. Therefore, the lower the Si content, the better. Especially when the Si content is over 0.20%, the decrease of yield strength is significant. Therefore, the Si content is 0.20% or less. The Si content is preferably 0.15% or less.

(P: 0.05% or less)

P is not an essential element but is contained as impurities in steel, for instance. P deteriorates toughness of the heat-treated steel material. Therefore, the lower the P content, the better. Especially when the P content is over 0.05%, the decrease of toughness is significant. Therefore, the P content is 0.05% or less. The P content is preferably 0.005% or less.

(S: 0.05% or less)

S is not an essential element but is contained as impurities in steel, for instance. S deteriorates toughness of the heat-treated steel material. Therefore, the lower the S content, the better. Especially when the S content is over 0.05%, the decrease of toughness is significant. Therefore, the S content is 0.05% or less. The S content is preferably 0.02% or less.

(N: 0.01% or less)

N is not an essential element but is contained as impurities in steel, for instance. N contributes to formation of coarse nitride and deteriorates local deformability and toughness of the heat-treated steel material. Therefore, the lower the N content, the better. Especially when the N content is over 0.01%, the decrease of local deformability and toughness is significant. Therefore, the N content is 0.01% or less. It requires a considerable cost to decrease the N content to less than 0.0008%, and it sometimes requires a more enormous cost to decrease it to less than 0.0002%.

Ni, Cu, Mo, V, Al, Nb, and REM are not essential elements but are optional elements that may be appropriately contained in the steel sheet for heat treatment and the heat-treated steel material, within ranges of predetermined limit amounts.

(Ni: 0% to 2.0%, Cu: 0% to 1.0%, Mo: 0% to 1.0%, V: 0% to 1.0%, Al: 0% to 1.0%, Nb: 0% to 1.0%, REM: 0% to 0.1%)

Ni, Cu, Mo, V, Al, Nb, and REM have a function to improve hardenability and/or toughness of the steel sheet for heat treatment. Therefore, one or any combination selected from the group consisting of these elements may be contained. However, when the Ni content is over 2.0%, the effect by the above function is saturated, only resulting in a wasteful cost increase. Therefore, the Ni content is 2.0% or less. When the Cu content is over 1.0%, the effect by the above function is saturated, only resulting in a wasteful cost increase. Therefore, the Cu content is 1.0% or less. When the Mo content is over 1.0%, the effect by the above function is saturated, only resulting in a wasteful cost increase. Therefore, the Mo content is 1.0% or less. When the V content is over 1.0%, the effect by the above function is saturated, only resulting in a wasteful cost increase. Therefore, the V content is 1.0% or less. When the Al content is over 1.0%, the effect by the above function is saturated, only resulting in a wasteful cost increase. Therefore, the Al content is 1.0% or less. When the Nb content is over 1.0%, the effect by the above function is saturated, only resulting in a wasteful cost increase. Therefore, the Nb content is 1.0% or less. When the REM content is over 0.1%, the effect by the above function is saturated, only resulting in a wasteful cost increase. Therefore, the REM content is 0.1% or less. To surely obtain the effect by the above function, the Ni content, the Cu content, the Mo content, and the V content all are preferably 0.1% or more, the Al content and the Nb content both are preferably 0.01% or more, and the REM content is preferably 0.001% or more. That is, it is preferable that "Ni: 0.1% to 2.0%", "Cu: 0.1% to 1.0%", "Mo: 0.1% to 1.0%", "V: 0.1% to 1.0%", "Al: 0.01% to 1.0%", "Nb: 0.01% to 1.0%", or "REM: 0.001% to 0.1%", or any combination thereof be satisfied. REM is added to molten steel using a Fe—Si-REM alloy, for instance, and this alloy contains Ce, La, Nd, and Pr, for instance.

Next, a structure of the heat-treated steel material according to the embodiment will be described. The heat-treated steel material according to the embodiment includes a structure expressed by: retained austenite: 1.5 volume % or less; and the balance: martensite. The martensite is, for example, auto-tempered martensite, but is not limited to the auto-tempered martensite.

(Retained Austenite: 1.5 Volume % or Less)

The retained austenite is not an essential structure but is unavoidably contained in the structure of the heat-treated steel material. The retained austenite causes a decrease of yield strength as described above, and accordingly as a volume fraction of the retained austenite is higher, yield strength is lower. Especially when the volume fraction of the retained austenite is over 1.5 volume %, the decrease of yield strength is significant, which makes it difficult to apply the heat-treated steel material to a bumper reinforce, a center pillar, and the like. Therefore, the volume fraction of the retained austenite is 1.5 volume % or less.

Next, the mechanical property of the heat-treated steel material according to the embodiment will be described. The heat-treated steel material according to the embodiment preferably includes a mechanical property expressed by a yield ratio: 0.70 or more. Collision resistance may be evaluated based on tensile strength, and yield strength and toughness suitable for tensile strength, and yield strength suitable for tensile strength is expressed by the yield ratio. Then, under a condition where tensile strength or yield strength is comparable, the higher the yield ratio, the better. When the yield ratio is less than 0.70, it is not sometimes possible to obtain sufficient collision resistance in the application in a bumper reinforce or a center pillar. Therefore, the yield ratio is preferably 0.70 or more.

Next, a method of manufacturing the heat-treated steel material, that is, a method of treating the steel sheet for heat treatment, will be described. In the treatment of the steel sheet for heat treatment, the steel sheet for heat treatment is heated to a temperature range of the $Ac_3$ point or higher, thereafter is cooled to a Ms point at a cooling rate equal to a critical cooling rate or more, and thereafter is cooled from the Ms point to 100° C. at an average cooling rate of 35° C./second or more.

Once the steel sheet for heat treatment is heated to the temperature range of the $Ac_3$ point or higher, the structure becomes an austenite single phase. If it is thereafter cooled to the Ms point at the cooling rate equal to the critical cooling rate or more, the structure of the austenite single phase is maintained without any occurrence of diffusion transformation. Once it is thereafter cooled from the Ms point to 100° C. at the average cooling rate of the 35° C./second or more, the structure in which the volume fraction of the retained austenite is 1.5 volume % or less and the balance is the martensite is obtained.

In the above-described manner, it is possible to manufacture the heat-treated steel material according to this embodiment having excellent collision resistance.

During the series of heating and cooling, hot forming such as hot stamping may be performed. Specifically, the steel sheet for heat treatment may be subjected to the forming in a die until the temperature reaches the Ms point after being heated to the temperature range of the $Ac_3$ point or higher. Bending, drawing, bulging, hole expansion, and flanging may be exemplified as the hot forming. These belong to press forming, but if it is possible to cool the steel sheet in parallel with the hot forming or immediately after the hot forming, hot forming such as roll forming, other than the press forming, may be performed.

In a case where the hot forming is performed, it is preferable that a pipe and an injection hole for a cooling medium are provided in the die, and the cooling medium is directly sprayed to the steel sheet for heat treatment during the cooling from the Ms point to 100° C., or while it is kept at a press bottom dead center, for example. Water, polyhydric alcohols, aqueous solutions of polyhydric alcohols, polyglycol, mineral oil whose flash point is 120° C. or higher, synthetic ester, silicone oil, fluorine oil, grease whose dropping point is 120° C. or higher, mineral oil, and water emulsion in which a surface active agent is compounded with synthetic ester may be exemplified as the cooling medium. One or any combination thereof may be usable. Using the die and the cooling medium as described above makes it possible to easily realize the 35° C./second cooling rate or more. Such a cooling method is described in Patent Literature 7, for example. As the series of heating and cooling, hardening by high-frequency heating may be performed.

The retention time in the temperature range of the $Ac_3$ point or higher is preferably one minute or more in order to sufficiently cause the transformation to the austenite. Generally, by the ten-minute retention, the structure becomes the austenite single phase, and the retention for more than ten minutes lowers productivity. Therefore, in view of productivity, the retention time is preferably ten minutes or less.

The steel sheet for heat treatment may be a hot-rolled steel sheet, or may be a cold-rolled steel sheet. An annealed hot-rolled steel sheet or an annealed cold-rolled steel sheet which is a hot-rolled steel sheet or a cold-rolled steel sheet having been subjected to annealing may be used as the steel sheet for heat treatment.

The steel sheet for heat treatment may be a surface-treated steel sheet such as a plated steel sheet. That is, a plating layer may be provided on the steel sheet for heat treatment. The plating layer contributes to an improvement of corrosion resistance, for instance. The plating layer may be an electroplating layer, or may be a hot-dip plating layer. An electrogalvanizing layer and a Zn—Ni alloy electroplating layer may be exemplified as the electroplating layer. A hot-dip galvanizing layer, an alloyed hot-dip galvanizing layer, a hot-dip aluminum plating layer, a hot-dip Zn—Al alloy plating layer, a hot-dip Zn—Al—Mg alloy plating layer, and a hot-dip Zn—Al—Mg—Si alloy plating layer may be exemplified as the hot-dip plating layer. A coating weight of the plating layer is not particularly limited, and is a coating weight within an ordinary range, for instance. Similarly to the steel sheet for heat treatment, the heat-treated steel material may be provided with a plating layer.

Next, an example of a method of manufacturing the steel sheet for heat treatment will be described. In this manufacturing method, hot rolling, pickling, cold rolling, annealing, and plating are performed, for instance.

In the hot rolling, a steel ingot or a steel billet having the aforesaid chemical composition whose temperature is 1050° C. or higher is hot-rolled, and thereafter, is coiled in a temperature range of not lower than 400° C. nor higher than 700° C.

The steel ingot or steel billet sometimes contains non-metal inclusions which are a cause to deteriorate toughness and local deformability of the heat-treated steel material obtained by the quenching of the steel sheet for heat treatment. Therefore, when the steel ingot or steel billet is subjected to the hot rolling, it is preferable to sufficiently solid-dissolve these non-metal inclusions. The solid dissolving of the aforesaid non-metal inclusions is promoted when the temperature of the steel ingot or steel billet having the above chemical composition has reached 1050° C. or higher when it is subjected to the hot rolling. Therefore, the temperature of the steel ingot or steel billet that is to be subjected to the hot rolling is preferably 1050° C. or higher. It is sufficient that the temperature of the steel ingot or steel billet is 1050° C. or higher when it is subjected to the hot rolling. That is, after continuous casting or the like, the steel ingot or steel billet whose temperature has become lower than 1050° C. may be heated to 1050° C. or higher, or the steel ingot after the continuous casting or the steel billet after bloom rolling may be subjected to the hot rolling without decreasing its temperature to lower than 1050° C.

By setting the coiling temperature to 400° C. or higher, it is possible to obtain a high ferrite area ratio. As the ferrite area ratio is higher, the strength of the hot-rolled steel sheet obtained by the hot rolling is reduced, and therefore, it becomes easy to control a load and control flatness and thickness of the steel sheet at the time of the later cold rolling, which improves manufacturing efficiency. Therefore, the coiling temperature is preferably 400° C. or higher.

When the coiling temperature is 700° C. or lower, it is possible to suppress scale growth after the coiling to suppress the generation of a scale flaw. When the coiling temperature is 700° C. or lower, the deformation due to the self-weight of a coil after the coiling is also suppressed, and the generation of a scratch flaw on a surface of the coil due to this deformation is suppressed. Therefore, the coiling temperature is preferably 700° C. or lower. The aforesaid deformation occurs because, when non-transformed austenite remains after the coiling of the hot rolling and this non-transformed austenite transforms to ferrite after the coiling, coiling tension of the coil is lost in accordance with volume expansion due to the ferrite transformation and the following thermal contraction.

The pickling may be performed by a common procedure. Skin pass rolling may be performed before the pickling or after the pickling. The skin pass rolling corrects flatness or promotes the peeling of scales, for instance. An elongation percentage when the skin pass rolling is performed is not particularly limited and, for example, is not less than 0.3% nor more than 3.0%.

In a case where a cold-rolled steel sheet is manufactured as the steel sheet for heat treatment, cold rolling of the pickled steel sheet obtained by the pickling is performed. The cold rolling may be performed by a common procedure. A reduction ratio of the cold rolling is not particularly limited, and is a reduction ratio within an ordinary range, for example, not less than 30% nor more than 80%.

In a case where an annealed hot-rolled steel sheet or an annealed cold-rolled steel sheet is manufactured as the steel sheet for heat treatment, the hot-rolled steel sheet or the cold-rolled steel sheet is annealed. In the annealing, the hot-rolled steel sheet or the cold-rolled steel sheet is kept in a temperature range of not lower than 550° C. nor higher than 950° C., for instance.

When the retention temperature in the annealing is 550° C. or higher, it is possible to reduce a difference in property accompanying a difference in a hot-rolling condition to further stabilize the property after the quenching, whichever of the annealed hot-rolled steel sheet or the annealed cold-rolled steel sheet is manufactured. Further, in a case where the cold-rolled steel sheet is annealed at 550° C. or higher, the cold-rolled steel sheet softens due to recrystallization, which can improve workability. That is, it is possible to obtain the annealed cold-rolled steel sheet having good workability. Therefore, the retention temperature in the annealing is preferably 550° C. or higher.

When the retention temperature in the annealing is higher than 950° C., the structure sometimes becomes coarse. When the structure becomes coarse, toughness after the quenching sometimes deteriorates. Further, even if the retention temperature in the annealing is higher than 950° C., the effect worth the temperature increase is not obtained, only resulting in cost increase and productivity decrease. Therefore, the retention temperature in the annealing is preferably 950° C. or lower.

After the annealing, cooling is preferably performed to 550° C. at an average cooling rate of not less than 3° C./second nor more than 20° C./second. When the above average cooling rate is 3° C./second or more, the generation of coarse pearlite and coarse cementite are suppressed, and it is possible to improve the property after the quenching. When the aforesaid average cooling rate is 20° C./second or less, the occurrence of strength unevenness or the like is suppressed, and stabilizing the quality of the annealed hot-rolled steel sheet or the annealed cold-rolled steel sheet is facilitated.

In a case where a plated steel sheet is manufactured as the steel sheet for heat treatment, electroplating or hot dipping is performed, for instance. The electroplating and the hot dipping both may be performed by a common procedure. For example, in a case where the hot-dip galvanizing is performed, a continuous hot-dip galvanizing facility may be used to continuously perform the plating subsequently to the aforesaid annealing. Alternatively, the plating may be performed independently of the aforesaid annealing. In the hot-dip galvanizing, alloying treatment may be performed to form an alloyed hot-dip galvanizing layer. In a case where the alloying treatment is performed, an alloying temperature is preferably not lower than 480° C. nor higher than 600° C. When the alloying temperature is 480° C. or higher, unevenness of the alloying treatment can be suppressed. When the alloying temperature is 600° C. or lower, it is possible to ensure high productivity as well as suppress a manufacturing cost. Skin pass rolling may be performed after the hot-dip galvanizing. The skin pass rolling corrects flatness, for instance. An elongation percentage when the skin pass rolling is performed is not particularly limited and may be an elongation percentage similar to that in a common procedure.

Note that the above-described embodiments all only present concrete examples in carrying out the present invention, and the technical scope of the present invention should not be construed in a limited manner by these. That is, the present invention may be embodied in various forms without departing from its technical idea or its main feature.

EXAMPLES

Next, experiments conducted by the inventors of the present application will be described.

First Experiment

In a first experiment, cold-rolled steel sheets each with a 1.4 mm thickness including the chemical compositions listed in Table 1 were manufactured as steel sheets for heat treatment. These steel sheets were manufactured by hot rolling and cold rolling of slabs prepared by melting in a laboratory. The underlines in Table 1 indicate that the numerical values were out of the ranges of the present invention.

TABLE 1

| STEEL TYPE | CHEMICAL COMPONENT (MASS %) | | | | | | | | | | | | | | | | Ac3 POINT | Ms POINT |
|---|---|---|---|---|---|---|---|---|---|---|---|---|---|---|---|---|---|---|
| No. | C | Mn | Cr | Ti | B | Si | P | S | N | Cu | Ni | Mo | V | Al | Nb | REM | (° C.) | (° C.) |
| 1 | 0.20 | 1.10 | 0.45 | 0.015 | 0.0022 | 0.08 | 0.010 | 0.0018 | 0.0032 | — | — | — | — | — | — | — | 777 | 392 |
| 2 | 0.21 | 1.00 | 0.41 | 0.020 | 0.0025 | 0.10 | 0.013 | 0.0020 | 0.0035 | — | — | — | — | 0.04 | — | 0.0025 | 758 | 393 |
| 3 | 0.18 | 1.20 | 0.42 | 0.025 | 0.0028 | 0.01 | 0.008 | 0.0011 | 0.0032 | 0.10 | — | — | 0.10 | — | — | — | 785 | 396 |
| 4 | 0.22 | 1.05 | 0.45 | 0.015 | 0.0028 | 0.05 | 0.015 | 0.0015 | 0.0032 | — | 0.1 | — | — | 0.07 | — | — | 741 | 388 |
| 5 | 0.19 | 0.71 | 0.63 | 0.019 | 0.0030 | 0.12 | 0.012 | 0.0014 | 0.0037 | — | 0.1 | — | — | — | — | — | 790 | 403 |
| 6 | 0.18 | 0.65 | 0.72 | 0.025 | 0.0025 | 0.18 | 0.011 | 0.0016 | 0.0027 | — | — | 0.05 | — | — | 0.02 | — | 795 | 406 |
| 7 | 0.20 | 0.81 | 0.41 | 0.021 | 0.0023 | 0.10 | 0.009 | 0.0010 | 0.0030 | — | — | 0.35 | — | — | — | 0.0035 | 785 | 402 |
| 8 | 0.21 | 1.20 | 0.62 | 0.018 | 0.0022 | 0.09 | 0.012 | 0.0012 | 0.0026 | — | — | — | — | — | 0.10 | — | 769 | 382 |
| 9 | 0.19 | 1.31 | 0.40 | 0.030 | 0.0026 | 2.05 | 0.011 | 0.0009 | 0.0025 | — | — | — | 0.10 | 0.04 | — | — | 838 | 367 |
| 10 | 0.18 | 2.00 | 0.20 | 0.020 | 0.0022 | 0.01 | 0.013 | 0.0020 | 0.0035 | 0.05 | — | — | — | — | 0.02 | 0.0019 | 747 | 374 |

Then, samples each with a 1.4 mm thickness, a 30 mm width, and a 200 mm length were taken from the cold-rolled steel sheets, and the samples were heat-treated (heated and cooled) under the conditions listed in Table 1. This heat treatment imitates heat treatment in hot forming. The heating in this experiment was performed by ohmic heating. After the heat treatment, soaking portions were taken from the samples, and these soaking portions were subjected to an X-ray diffraction test, a tensile test, and a Charpy impact test. A cooling rate (80° C./second) to an Ms point was equal to a critical cooling rate or more.

In the X-ray diffraction test, portions up to ⅛ depth of the thickness from surfaces of the soaking portions were chemically polished using hydrofluoric acid or a hydrogen peroxide solution, whereby specimens for the X-ray diffraction test were prepared, and volume fractions (volume %) of retained austenite (retained γ) in these specimens were found. Note that the remainder other than the retained austenite was martensite.

In the tensile test, the soaking portions were worked into half-size plate-shaped specimens of ASTM E8 having a 1.2 mm thickness, and the tensile test of the specimens was conducted, and their tensile strengths and yield strengths were measured. A length of a parallel portion of each of the half-size plate-shaped specimens is 32 mm and a width of the parallel portion is 6.25 mm. Further, yield ratios were calculated from the tensile strengths and the yield strengths.

In the Charpy impact test, the soaking portions were polished until their thickness became 1.2 mm, and V-notched specimens in which three pieces of them were stacked were prepared, and these specimens were subjected to the Charpy impact test, and impact values at −80° C. were found.

The results of these are listed in Table 2. The underlines in Table 2 indicate that the numerical values were out of the ranges of the present invention or were out of the preferable ranges.

TABLE 2

| SAMPLE No. | STEEL TYPE No. | HEATING RATE TO 900° C. (° C./SEC) | RETENTION TIME (SEC) | AVERAGE COOLING RATE TO Ms POINT (° C./SEC) | AVERAGE COOLINIG RATE FROM Ms POINT TO 100° C. (° C./SEC) | VOLUME FRACTION OF RETAINED AUSTENITE (VOLUME %) |
|---|---|---|---|---|---|---|
| 1 | 1 | 10 | 210 | 80 | 197.5 | 1.24 |
| 2 | | | | | 36.5 | 1.40 |
| 3 | | | | | 25.1 | 1.69 |
| 4 | | | | | 2.1 | 2.82 |
| 5 | 2 | | | | 194.9 | 1.25 |
| 6 | | | | | 35.5 | 1.45 |
| 7 | | | | | 29.1 | 1.62 |
| 8 | | | | | 2.4 | 2.80 |
| 9 | 3 | | | | 200.4 | 1.22 |
| 10 | | | | | 36.2 | 1.42 |
| 11 | | | | | 30.1 | 1.61 |
| 12 | | | | | 2.2 | 2.77 |
| 13 | 4 | | | | 180.2 | 1.32 |
| 14 | 5 | | | | 42.4 | 1.40 |
| 15 | 6 | | | | 2.8 | 2.76 |
| 16 | 7 | | | | 45.8 | 1.32 |
| 17 | 8 | | | | 42.3 | 1.42 |
| 18 | 9 | | | | 174.9 | 1.75 |
| 19 | | | | | 45.5 | 2.06 |
| 20 | 10 | | | | 190.4 | 1.10 |
| 21 | | | | | 43.0 | 1.20 |

| SAMPLE No. | TENSILE STRENGTH (MPa) | YIELD STRENGTH (MPa) | YIELD RATIO | IMPACT VALUE (J/cm$^2$, −80° C.) | REMARKS |
|---|---|---|---|---|---|
| 1 | 1543 | 1093 | 0.71 | 61 | INVENTIVE EXAMPLE |
| 2 | 1489 | 1045 | 0.70 | 62 | INVENTIVE |

TABLE 2-continued

| | | | | | |
|---|---|---|---|---|---|
| | | | | | EXAMPLE |
| 3 | 1478 | 1020 | 0.69 | 63 | COMPARATIVE EXAMPLE |
| 4 | 1462 | 986 | 0.67 | 65 | COMPARATIVE EXAMPLE |
| 5 | 1537 | 1093 | 0.71 | 60 | INVENTIVE EXAMPLE |
| 6 | 1486 | 1041 | 0.70 | 63 | INVENTIVE EXAMPLE |
| 7 | 1476 | 1018 | 0.69 | 64 | COMPARATIVE EXAMPLE |
| 8 | 1468 | 989 | 0.67 | 66 | COMPARATIVE EXAMPLE |
| 9 | 1545 | 1095 | 0.71 | 60 | INVENTIVE EXAMPLE |
| 10 | 1478 | 1043 | 0.71 | 62 | INVENTIVE EXAMPLE |
| 11 | 1474 | 1019 | 0.69 | 63 | COMPARATIVE EXAMPLE |
| 12 | 1470 | 991 | 0.67 | 65 | COMPARATIVE EXAMPLE |
| 13 | 1540 | 1102 | 0.72 | 60 | INVENTIVE EXAMPLE |
| 14 | 1475 | 1041 | 0.71 | 62 | INVENTIVE EXAMPLE |
| 15 | 1472 | 988 | 0.67 | 66 | COMPARATIVE EXAMPLE |
| 16 | 1515 | 1070 | 0.71 | 63 | INVENTIVE EXAMPLE |
| 17 | 1499 | 1058 | 0.71 | 62 | INVENTIVE EXAMPLE |
| 18 | 1467 | 981 | 0.67 | 62 | COMPARATIVE EXAMPLE |
| 19 | 1442 | 932 | 0.65 | 65 | COMPARATIVE EXAMPLE |
| 20 | 1511 | 1095 | 0.72 | 40 | COMPARATIVE EXAMPLE |
| 21 | 1505 | 1065 | 0.71 | 43 | COMPARATIVE EXAMPLE |

As listed in Table 2, in the samples No. 1, No. 2, No. 5, No. 6, No. 9, No. 10, No. 13, No. 14, No. 16, and No. 17, since their chemical compositions and structures were within the ranges of the present invention, tensile strengths equal to or more than 1400 MPa were obtained, excellent yield ratios equal to or higher than 0.70 were obtained, and impact values equal to or more than 50 J/cm$^2$, which is preferable for the tensile strength of 1400 MPa or more, were obtained.

In the samples No. 3, No. 4, No. 7, No. 8, No. 11, No. 12, and No. 15, though their chemical compositions were within the range of the present invention, their structures were out of the range of the present invention, and therefore their yield ratios were low as less than 0.70.

In the samples No. 1, No. 2, No. 5, No. 6, No. 9, No. 10, No. 13, No. 14, No. 16, and No. 17, since their average cooling rates from Ms points to 100° C. were all 35° C./s or more and their manufacturing conditions were within the range of the present invention, desired structures were obtained. On the other hand, in the samples No. 3, No. 4, No. 7, No. 8, No. 11, No. 12, and No. 15, since their average cooling rates from Ms points to 100° C. were all less than 35° C./s and their manufacturing conditions were out of the range of the present invention, the desired structure could not be obtained.

In the samples No. 18 and No. 19, since their Si contents were out of the range of the present invention, their volume fractions of retained austenite were over 1.5 volume % and their yield ratios were less than 0.70 even though their average cooling rates from Ms points to 100° C. were 35° C./s or more.

In the samples No. 20 and No. 21, since their Mn contents were out of the range of the present invention, their impact values were less than 50 J/cm$^2$ and the desired toughness could not be obtained.

Second Experiment

In a second experiment, cold-rolled steel sheets each with a 1.4 mm thickness having the chemical compositions listed in Table 3 were manufactured as steel sheets for heat treatment. These steel sheets were manufactured by hot rolling and cold rolling of slabs prepared by melting in a laboratory. The underlines in Table 3 indicate that the numerical values were out of the ranges of the present invention.

TABLE 3

| STEEL TYPE | CHEMICAL COMPONENT (MASS %) | | | | | | | | | | | | | | | | Ac3 POINT | Ms POINT |
|---|---|---|---|---|---|---|---|---|---|---|---|---|---|---|---|---|---|---|
| No. | C | Mn | Cr | Ti | B | Si | P | S | N | Cu | Ni | Mo | V | Al | Nb | REM | (° C.) | (° C.) |
| 11 | 0.30 | 1.20 | 0.45 | 0.015 | 0.0022 | 0.08 | 0.010 | 0.0018 | 0.0033 | — | — | — | — | — | — | — | 818 | 389 |
| 12 | 0.34 | 1.00 | 0.40 | 0.020 | 0.0025 | 0.10 | 0.013 | 0.0020 | 0.0034 | — | — | — | — | 0.04 | — | 0.0027 | 812 | 377 |

TABLE 3-continued

| STEEL TYPE | CHEMICAL COMPONENT (MASS %) | | | | | | | | | | | | | | | | Ac3 POINT | Ms POINT |
|---|---|---|---|---|---|---|---|---|---|---|---|---|---|---|---|---|---|---|
| No. | C | Mn | Cr | Ti | B | Si | P | S | N | Cu | Ni | Mo | V | Al | Nb | REM | (° C.) | (° C.) |
| 13 | 0.28 | 1.20 | 0.42 | 0.025 | 0.0028 | 0.10 | 0.008 | 0.0011 | 0.0032 | 0.10 | — | — | 0.10 | — | — | — | 819 | 394 |
| 14 | 0.31 | 1.10 | 0.45 | 0.015 | 0.0028 | 0.05 | 0.015 | 0.0015 | 0.0032 | — | 0.1 | — | — | 0.07 | — | — | 816 | 387 |
| 15 | 0.29 | 0.71 | 0.63 | 0.020 | 0.0030 | 0.12 | 0.012 | 0.0014 | 0.0038 | — | 0.1 | — | — | — | — | — | 827 | 404 |
| 16 | 0.28 | 0.65 | 0.72 | 0.025 | 0.0025 | 0.18 | 0.011 | 0.0016 | 0.0026 | — | — | 0.05 | — | — | 0.02 | — | 831 | 408 |
| 17 | 0.30 | 0.82 | 0.41 | 0.021 | 0.0023 | 0.10 | 0.009 | 0.0010 | 0.0030 | — | — | 0.35 | — | — | — | 0.0042 | 825 | 400 |
| 18 | 0.31 | 1.20 | 0.63 | 0.018 | 0.0022 | 0.09 | 0.012 | 0.0012 | 0.0026 | — | — | — | — | — | 0.10 | — | 811 | 377 |
| 19 | 0.32 | 1.31 | 0.40 | 0.030 | 0.0026 | 2.10 | 0.011 | 0.0009 | 0.0024 | — | — | — | 0.10 | 0.04 | — | — | 872 | 359 |
| 20 | 0.28 | 2.00 | 0.10 | 0.020 | 0.0022 | 0.01 | 0.013 | 0.0020 | 0.0034 | 0.05 | — | — | — | — | 0.02 | 0.0021 | 806 | 368 |

Then, heat treatment and evaluation tests similar to those of the first experiment were conducted. The results of these are listed in Table 4. The underlines in Table 4 indicate that the numerical values were out of the ranges of the present invention or were out of the preferable ranges.

TABLE 4

| SAMPLE No. | STEEL TYPE No. | HEATING RATE TO 900° C. (° C./SEC) | RETENTION TIME (SEC) | AVERAGE COOLING RATE TO Ms POINT (° C./SEC) | AVERAGE COOLINIG RATE FROM Ms POINT TO 100° C. (° C./SEC) | VOLUME FRACTION OF RETAINED AUSTENITE (VOLUME %) |
|---|---|---|---|---|---|---|
| 31 | 11 | 10 | 210 | 80 | 198.5 | 1.34 |
| 32 | | | | | 34.6 | 1.44 |
| 33 | | | | | 2.0 | 2.93 |
| 34 | 12 | | | | 197.8 | 1.35 |
| 35 | | | | | 35.3 | 1.46 |
| 36 | | | | | 2.3 | 2.90 |
| 37 | 13 | | | | 200.1 | 1.25 |
| 38 | | | | | 36.5 | 1.43 |
| 39 | | | | | 2.3 | 2.88 |
| 40 | 14 | | | | 179.9 | 1.31 |
| 41 | 15 | | | | 43.3 | 1.41 |
| 42 | 16 | | | | 2.7 | 2.82 |
| 43 | 17 | | | | 46.1 | 1.32 |
| 44 | 18 | | | | 41.9 | 1.43 |
| 45 | 19 | | | | 174.9 | 1.83 |
| 46 | | | | | 45.9 | 2.11 |
| 47 | 20 | | | | 192.1 | 1.13 |
| 48 | | | | | 43.4 | 1.25 |

| SAMPLE No. | TENSILE STRENGTH (MPa) | YIELD STRENGTH (MPa) | YIELD RATIO | IMPACT VALUE (J/cm2, −80° C.) | REMARKS |
|---|---|---|---|---|---|
| 31 | 1943 | 1399 | 0.72 | 42 | INVENTIVE EXAMPLE |
| 32 | 1886 | 1319 | 0.70 | 43 | INVENTIVE EXAMPLE |
| 33 | 1697 | 1154 | 0.68 | 46 | COMPARATIVE EXAMPLE |
| 34 | 2110 | 1519 | 0.72 | 41 | INVENTIVE EXAMPLE |
| 35 | 2049 | 1435 | 0.70 | 42 | INVENTIVE EXAMPLE |
| 36 | 1853 | 1223 | 0.66 | 45 | COMPARATIVE EXAMPLE |
| 37 | 1851 | 1351 | 0.73 | 42 | INVENTIVE EXAMPLE |
| 38 | 1800 | 1270 | 0.71 | 43 | INVENTIVE EXAMPLE |
| 39 | 1626 | 1106 | 0.68 | 45 | COMPARATIVE EXAMPLE |
| 40 | 1979 | 1464 | 0.74 | 41 | INVENTIVE EXAMPLE |
| 41 | 1810 | 1277 | 0.71 | 43 | INVENTIVE EXAMPLE |
| 42 | 1635 | 1079 | 0.66 | 47 | COMPARATIVE EXAMPLE |
| 43 | 1869 | 1364 | 0.73 | 43 | INVENTIVE EXAMPLE |

TABLE 4-continued

| | | | | | |
|---|---|---|---|---|---|
| 44 | 1944 | 1372 | 0.71 | 42 | INVENTIVE EXAMPLE |
| 45 | 2184 | 1462 | 0.67 | 41 | COMPARATIVE EXAMPLE |
| 46 | 2141 | 1434 | 0.67 | 43 | COMPARATIVE EXAMPLE |
| 47 | 1926 | 1406 | 0.73 | 30 | COMPARATIVE EXAMPLE |
| 48 | 1884 | 1319 | 0.70 | 32 | COMPARATIVE EXAMPLE |

As listed in Table 4, in the samples No. 31, No. 32, No. 34, No. 35, No. 37, No. 38, No. 40, No 41, No. 43, and No. 44, since their chemical compositions and structures were within the ranges of the present invention, tensile strengths equal to or more than 1800 MPa were obtained, excellent yield ratios equal to or higher than 0.70 were also obtained, and when the tensile strength was 1800 MPa or more, impact values equal to or more than 40 J/cm$^2$, which is preferable for the tensile strength of 1800 MPa or more, were obtained.

In the samples No. 33, No. 36, No. 39, and No. 42, though their chemical compositions were within the range of the present invention, their structures were out of the range of the present invention, and therefore their yield ratios were low as less than 0.70.

In the samples No. 31, No. 32, No. 34, No. 35, No. 37, No. 38, No. 40, No. 41, No. 43, and No. 44, since their average cooling rates from Ms points to 100° C. were all 35° C./s or more and their manufacturing conditions were all within the range of the present invention, desired structures were obtained. On the other hand, in the samples No. 33, No. 36, No. 39, and No. 42, since their average cooling rates from Ms points to 100° C. were all less than 35° C./s and their manufacturing conditions were out of the range of the present invention, the desired structure could not be obtained.

In the samples No. 45 and No. 46, since their Si contents were out of the range of the present invention, volume fractions of retained austenite were over 1.5 vol %, and yield ratios were less than 0.70 even though their average cooling rates from Ms points to 100° C. were 35° C./s or more.

In the samples No. 47 and No. 48, since their Mn contents were out of the range of the present invention, their impact values were less than 40 J/cm$^2$ and the desired toughness could not be obtained.

INDUSTRIAL APPLICABILITY

The present invention may be utilized for the industries manufacturing heat-treated members and the like used for automobiles, such as, for example, a bumper reinforce and a center pillar, and in the industries using these. The present invention may also be utilized for the industries manufacturing other mechanical structural components, the industries using them, and the like.

The invention claimed is:

1. A heat-treated steel material comprising:

a chemical composition comprising, in mass %:

C: 0.16% to 0.38%;
Mn: 0.6% to 1.5%;
Cr: 0.4% to 2.0%;
Ti: 0.01% to 0.10%;
B: 0.001% to 0.010%;
Si: 0.20% or less;
P: 0.05% or less;
S: 0.05% or less;
N: 0.010% or less;
Ni: 0% to 2.0%;
Cu: 0% to 1.0%;
Mo: 0% to 1.0%;
V: 0% to 1.0%;
Al: 0% to 1.0%;
Nb: 0% to 1.0%;
REM: 0% to 0.1%; and
the balance: Fe and impurities; and a structure consisting of:

retained austenite: 1.5 volume % or less; and
the balance: martensite;

wherein a yield ratio of the steel material is 0.70 or more.

2. The heat-treated steel material according to claim 1, wherein C: 0.16 to 0.25% in the chemical composition.

3. The heat-treated steel material according to claim 1, wherein the chemical composition comprises Al: 0.01%-2.0%.

4. The heat-treated steel material according to claim 1, wherein the chemical composition satisfies at least one of:

Ni: 0.1% to 2.0%;
Cu: 0.1% to 1.0%;
Mo: 0.1% to 1.0%;
V: 0.1% to 1.0%;
Al: 0.01% to 1.0%;
Nb: 0.01% to 1.0%; or
REM: 0.001% to 0.1%.

5. A method of manufacturing the heat-treated steel material of claim 1, comprising:

heating a steel sheet to a temperature of an $Ac_3$ point or higher;

next cooling the steel sheet to a Ms point at a cooling rate equal to a critical cooling rate or more; and next cooling the steel sheet from the Ms point to 100° C. at a 35° C./second average cooling rate or more, wherein the steel sheet comprises a chemical composition comprising, in mass %:

C: 0.16% to 0.38%;
Mn: 0.6% to 1.5%;
Cr: 0.4% to 2.0%;
Ti: 0.01% to 0.10%;
B: 0.001% to 0.010%;
Si: 0.20% or less;
P: 0.05% or less;
S: 0.05% or less;
N: 0.010% or less;
Ni: 0% to 2.0%;
Cu: 0% to 1.0%;
Mo: 0% to 1.0%;
V: 0% to 1.0%;
Al: 0% to 1.0%;
Nb: 0% to 1.0%;
REM: 0% to 0.1%; and
the balance: Fe and impurities; and a structure consisting of:

retained austenite: 1.5 volume % or less; and the balance: martensite;

wherein a yield ratio of the steel material is 0.70 or more.

6. The method of manufacturing the heat-treated steel material according to claim 5, wherein C: 0.16 to 0.25% in the chemical composition.

7. The method of manufacturing the heat-treated steel material according to claim 5, wherein the chemical composition satisfies:

Ni: 0.1% to 2.0%;

Cu: 0.1% to 1.0%;

Mo: 0.1% to 1.0%;

V: 0.1% to 1.0%;

Al: 0.01% to 1.0%;

Nb: 0.01% to 1.0%; or

REM: 0.001% to 0.1%; or any combination thereof.

8. The method of manufacturing the heat-treated steel material according to claim 5, comprising forming the steel sheet after the heating the steel sheet to the temperature of the $Ac_3$ point or higher before a temperature of the steel sheet reaches the Ms point.

* * * * *